US008805255B2

(12) United States Patent
Lee et al.

(10) Patent No.: US 8,805,255 B2
(45) Date of Patent: Aug. 12, 2014

(54) FUSING APPARATUS AND ELECTROPHOTOGRAPHIC IMAGE FORMING APPARATUS USING THE SAME

(75) Inventors: Jin-seok Lee, Suwon-si (KR); Bong-hee Lee, Suwon-si (KR); Sang-uk Jeon, Yongin-si (KR); Dong-kyun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 336 days.

(21) Appl. No.: 13/200,984

(22) Filed: Oct. 6, 2011

(65) Prior Publication Data

US 2012/0207524 A1 Aug. 16, 2012

(30) Foreign Application Priority Data

Feb. 11, 2011 (KR) ..... 10-2011-0012472

(51) Int. Cl.
*G03G 15/20* (2006.01)

(52) U.S. Cl.
USPC ..... 399/323; 399/322

(58) Field of Classification Search
USPC ..... 399/322, 323
See application file for complete search history.

(56) References Cited

U.S. PATENT DOCUMENTS

| | | | | |
|---|---|---|---|---|
| 3,957,423 | A * | 5/1976 | Mueller | 432/60 |
| 4,748,473 | A | 5/1988 | Tsuruoka | |
| 5,532,810 | A * | 7/1996 | Cahill | 399/323 |
| 6,813,464 | B2 * | 11/2004 | Amita et al. | 399/323 |

FOREIGN PATENT DOCUMENTS

| | | |
|---|---|---|
| JP | 2007-24948 | 2/2007 |
| JP | 2008-33068 | 2/2008 |

* cited by examiner

*Primary Examiner* — David Gray
*Assistant Examiner* — Michael Harrison
(74) *Attorney, Agent, or Firm* — Staas & Halsey LLP

(57) ABSTRACT

A fusing apparatus to fuse a toner image transferred to a printing medium by applying heat and pressure. The fusing apparatus includes a separation member that is rotatably mounted on a rotation axis to separate the printing medium from one of a heating roller and a pressing roller. The separation member includes a hollow portion into which the rotation axis is inserted, and a separation portion that contacts an outer circumference of the heating roller. The separation member is installed so as to be pitched around the rotation axis and a pitching axis having an inclination angle within a range of ±10° with respect to a line that connects a contact point between the separation portion and the outer circumference of the roller from which the printing medium is to be separated and a center of the roller from which the printing medium is to be separated.

13 Claims, 7 Drawing Sheets

FUSING APPARATUS AND ELECTROPHOTOGRAPHIC IMAGE FORMING APPARATUS USING THE SAME

CROSS-REFERENCE TO RELATED APPLICATIONS

This application claims the benefit of Korean Patent Application No. 10-2011-0012472, filed on Feb. 11, 2011, in the Korean Intellectual Property Office, the disclosure of which is incorporated herein in its entirety by reference.

BACKGROUND

1. Field

The present disclosure relates to a fusing apparatus for fusing a toner image transferred to a printing medium, by using heat and pressure, and an electrophotographic image forming apparatus using the fusing apparatus.

2. Description of the Related Art

Image forming apparatuses using an electrophotographic method form an electrostatic latent image on a surface of a photoreceptor by irradiating light that is modulated in response to image information, onto the photoreceptor, and supply toner to the electrostatic latent image to develop the same to a visible toner image. Then the image forming apparatuses transfer the toner image to a printing medium and fuse the transferred toner image to print the same on the printing medium.

SUMMARY

The present disclosure provides a fusing apparatus to fuse a toner image transferred to a printing medium by applying heat and pressure, including a heating roller and a pressing roller that form a fusing nip and rotate by being engaged with each other. In a fusing operation, a printing medium that has passed through the fusing nip may not be separated from the heating roller or the pressing roller but be adhered to an outer circumference of the heating roller or the pressing roller, thereby causing a jam. To prevent this, a separation member that separates the printing medium from the heating roller may be included.

The present disclosure provides a fusing apparatus with which a printing medium can be easily separated from a heating roller or a pressing roller, and an electrophotographic image forming apparatus including the fusing apparatus.

The present disclosure also provides a fusing apparatus that is capable of reducing possibility of damage to a heating roller or a pressing roller, and an electrophotographic image forming apparatus including the fusing apparatus.

According to an aspect of the present disclosure, there is provided a fusing apparatus to fuse a toner image transferred to a printing medium by applying heat and pressure, including a heating roller and a pressing roller that form a fusing nip and rotate by being engaged with each other; a separation member that separates a printing medium passed through the fusing nip, from one of the heating roller and the pressing roller, the separation member including a separation portion that contacts an outer circumference of the roller from which the printing medium is to be separated, and is capable of rotating around a rotation axis that is parallel to a lengthwise direction of the roller from which the printing medium is to be separated; and an elastic member that applies an elastic force to the separation member that rotates the separation portion to contact the outer circumference of the roller from which the printing medium is to be separated, wherein the separation member includes a hollow portion into which the rotation axis is inserted, wherein the hollow portion includes a center portion rotatably supporting the rotation axis and two end portions having a long hole shape, wherein a long axis direction of the two end portions has an inclination angle within a range of ±10° with respect to a line that connects a contact point between the separation portion and the outer circumference of the roller from which the printing medium is to be separated and the center of the roller from which the printing medium is to be separated, so that the separation member is pitched in the direction of the long axis.

The hollow portion may have a cross-section having a long hole shape whose long axis length gradually increases from the center portion toward the two end portions of the hollow portion.

The center portion may have a circular cross-section.

The long axis of the long hole may be parallel to the line that connects the contact point between the separation portion and the outer circumference of the roller from which the printing medium is to be separated and the center of the roller from which the printing medium is to be separated.

The roller from which the printing medium is to be separated may be the heating roller.

According to another aspect of the present disclosure, there is provided a fusing apparatus to fuse a toner image transferred to a printing medium by applying heat and pressure, the apparatus including a heating roller and a pressing roller that form a fusing nip and rotate by being engaged with each other; a separation member that separates a printing medium passed through the fusing nip, from the heating roller, the separation member including a separation portion that contacts an outer circumference of the heating roller and is capable of rotating around a rotation axis that is in parallel with a lengthwise direction of the heating roller; and an elastic member that applies an elastic force to the separation member that rotates the separation portion to contact the outer circumference of the heating roller, wherein the separation member is installed to be pitched around a pitching axis having an inclination angle within a range of ±10° with respect to a line that connects the contact point between the separation portion and the outer circumference of the heating roller and the center of the heating roller.

According to another aspect of the present disclosure, there is provided a electrophotographic image forming apparatus including: a photoreceptor on which an electrostatic latent image is formed; a developer that supplies a toner to the electrostatic latent image to form a visible toner image; and a fusing apparatus that fuses the toner image transferred to a printing medium by applying heat and pressure.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

The present disclosure will now be described more fully with reference to the accompanying drawings, in which exemplary embodiments of the present disclosure are shown.

Figure 1:
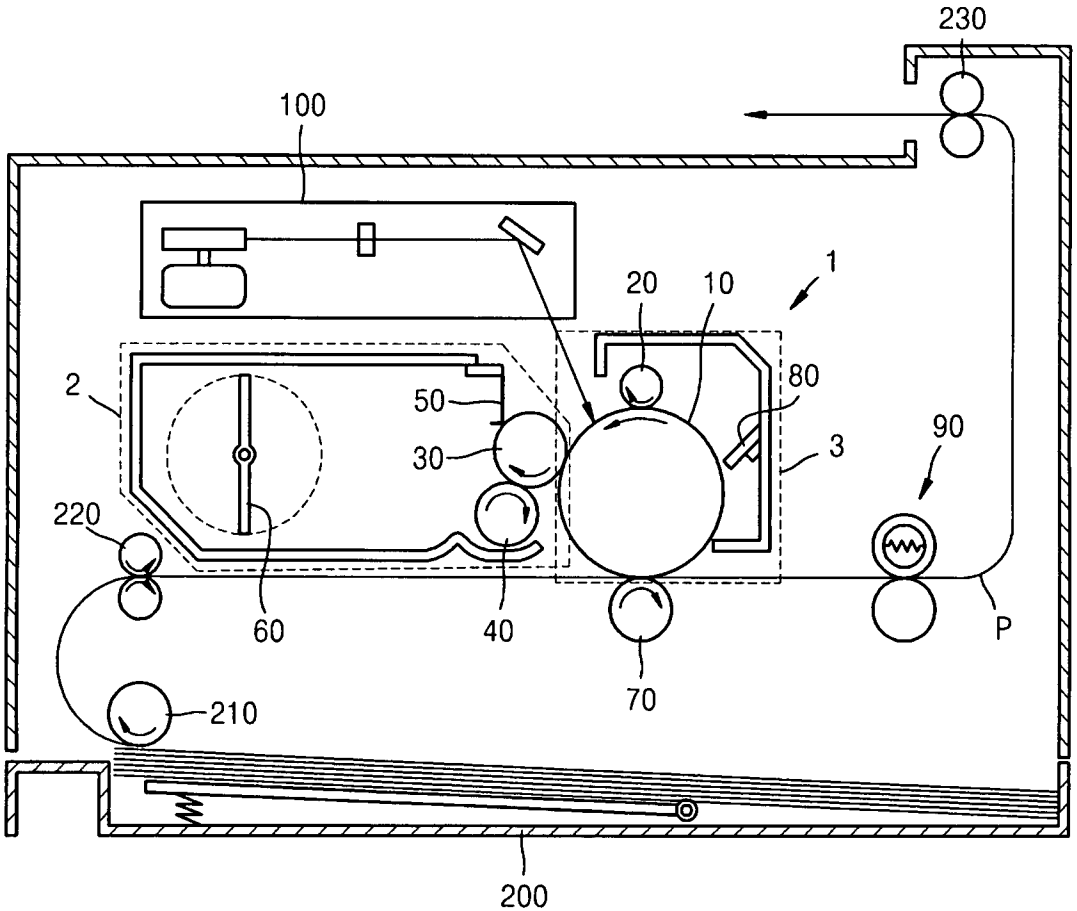
FIG. 1 is a structural diagram illustrating an electrophotographic image forming apparatus according to an embodiment of the present disclosure.

FIG. 1 is a structural diagram illustrating an electrophotographic image forming apparatus according to an embodiment of the present disclosure. The image forming apparatus is a single-component developing type monochromatic image forming apparatus that uses a non-magnetic toner as a developer. The color of the toner is, for example, black.

A photosensitive drum 10 is an example of a photoreceptor on which an electrostatic latent image is formed. The photosensitive drum 10 may include a photosensitive layer having photoconductivity formed on an external circumference of a cylindrical metal pipe. Instead of the photosensitive drum 10, a photosensitive belt having a photosensitive layer formed on an outer surface of a circulating belt may be used.

A charging roller 20 is an example of a charger that charges a surface of the photosensitive drum 10 with a uniform charge potential. The charging roller 20 rotates in contact with the surface of the photosensitive drum 10. A charge bias is applied to the charging roller 20. Instead of the charging roller 20, a corona charger that uses a corona discharge may be used.

An exposure unit 100 forms an electrostatic latent image by irradiating light corresponding to image information, onto the surface of the charged photosensitive drum 10. The exposure unit 100 may be, for example, a laser scanning unit (LSU) that irradiates light onto the photosensitive drum 10 by deflecting light irradiated from a laser diode using a polygon mirror in a main scanning direction.

A developer 1 supplies toner accommodated therein to the electrostatic latent image formed on the photosensitive drum 10 to form a visible toner image on the surface of the photosensitive drum 10. A developing roller 30 is disposed to face the photosensitive drum 10. If a non-contact developing method is used, the developing roller 30 may be separated from the photosensitive drum 10 by a development gap. The development gap may be set to be several tens to hundreds of microns. If a contact type development method is used, the developing roller 30 is rotated in contact with the photosensitive drum 10. If a two-component developer including magnetic carriers and non-magnetic toner is used as a developer, the developing roller 30 is separated from the photosensitive drum 10. In this case, the developing roller 30 may include a rotating sleeve and a magnet disposed inside the sleeve. The magnetic carriers are attached to a surface of the sleeve due to a magnetic force, and the toner is attached to the carriers due to an electrostatic force. Hereinafter, a non-contact type single-component developing method will be described.

The toner accommodated in the developer 1 is transported to the developing roller 30 by an agitator 60, and is attached to a surface of the developing roller 30 by a supply roller 40 that rotates in contact with the developing roller 30. Accordingly, a toner layer is formed on the surface of the developing roller 30. A regulation member 50 regulates a thickness of the toner layer formed on the surface of the developing roller 30 to be uniform. The regulation member 50 may be, for example, a regulation blade that is formed of a thin metal plate having elasticity, such as stainless steel, phosphor bronze, or the like, and is in contact with the surface of the developing roller 30. A developing bias that develops the electrostatic latent image formed on the photosensitive drum 10 using the toner on the surface of the developing roller 30 to so as to form the visible toner image on the surface of the photosensitive drum 10 is applied to the developing roller 30.

A transfer roller 70 is an example of a transfer unit that transfers the toner image formed on the surface of the photosensitive drum 10 to a printing medium P. A transfer bias is applied to the transfer roller 70. The toner image developed on the surface of the photosensitive drum 10 is transferred to the printing medium P by a transfer electric field that is formed between the photosensitive drum 10 and the transfer roller 70 by the transfer bias. Instead of the transfer roller 70, a corona transfer unit using a corona discharge may be used.

A cleaning member 80 that removes toner remaining on the surface of the photosensitive drum 10 is included.

The toner image transferred to the printing medium P is attached to the printing medium P by an electrostatic force. A fusing apparatus 90 fuses the toner image to the printing medium P by applying heat and pressure thereto.

The developer 1 may be provided in the form of a process cartridge that includes the photosensitive drum 10 and the developing roller 30. Alternatively, the developer 1 may be divided into a development cartridge 2 including the developing roller 30 and a photoreceptor cartridge 3 including the photosensitive drum 10.

Hereinafter, an image forming method using the above-described electrophotographic image forming apparatus will be described.

When a charge bias is applied to the charging roller 20, the surface of the photosensitive drum 10 is charged with a uniform potential. The exposure unit 100 irradiates light corresponding to image information onto the surface of the photosensitive drum 10 to form an electrostatic latent image. When a developing bias is applied to the developing roller 30 and a developing electric field is formed between the developing roller 30 and the photosensitive drum 10 accordingly, toner moves from a toner layer formed on the surface of the developing roller 30 to the surface of the photosensitive drum 10, thereby developing the electrostatic latent image. Thus, a visible toner image is formed on the surface of the photosensitive drum 10. A printing medium P that is picked up by a pickup roller 210 from a paper feeding unit 200 is supplied by a feed roller 220 to an area where the photosensitive drum 10 and the transfer roller 70 face each other. The toner image is transferred and attached to the printing medium P from the surface of the photosensitive drum 10 by a transfer electric field that is formed between the photosensitive drum 10 and the transfer roller 70 by a transfer bias. When the printing medium P passes through the fusing apparatus 90, the toner image is fused on the printing medium P by heat and pressure, thereby completing printing of an image. The printing medium P is discharged by a discharging roller 230. The cleaning member 80 contacts the surface of the photosensitive drum 10 to remove toner remaining on the surface of the photosensitive drum 10 after the transferring.

Figure 2:
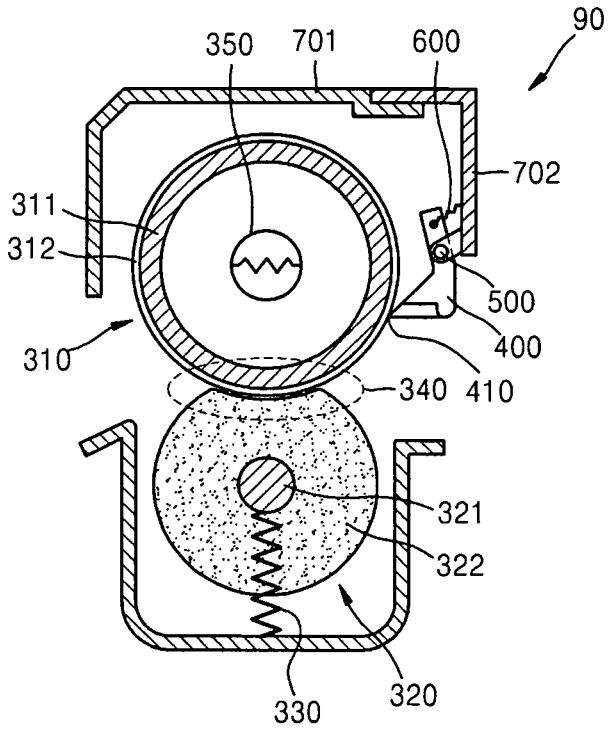
FIG. 2 is a structural diagram illustrating a fusing apparatus illustrated in FIG. 1 according to an embodiment of the present disclosure.

FIG. 2 is a structural diagram illustrating the fusing apparatus 90 illustrated in FIG. 1 according to an embodiment of the present disclosure. Referring to FIG. 2, the fusing apparatus 90 includes a heating roller 310 and a pressing roller 320. The heating roller 310 and the pressing roller 320 rotate by being engaged with each other. The heating roller 310 may include a metallic hollow pipe 311 and a releasing layer 312 formed on an outer circumference of the pipe 311. The releasing layer 312 is used to prevent toner fused during a fusing operation from being offset from the printing medium P to the heating roller 310, and may be formed of a material having excellent heat-resistant properties, such as a Teflon compound. A heat source 350 may be mounted inside the heating roller 310. The heat source 350 may be, for example, a halogen lamp. The type and shape of the heat source 350 to heat the heating roller 310 is not limited to as illustrated in FIG. 2 and various types of heat sources, such as an induction heating type heat source, may also be used.

Figure 3:
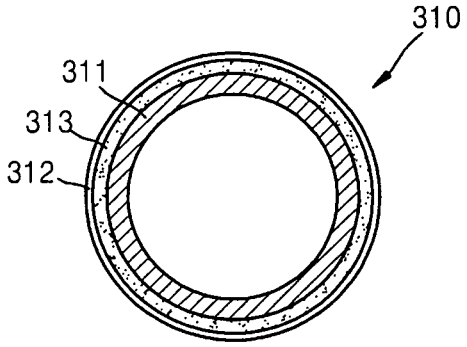
FIG. 3 is a cross-sectional view illustrating a heating roller according to another embodiment of the present disclosure.

As illustrated in FIG. 3, the heating roller 310 may include an elastic layer 313 formed between the metallic hollow pipe 311 and the releasing layer 312.

The pressing roller 320 may include, for example, a metallic core 321 and an elastic layer 322 formed on an outer circumference of the metallic core 321. The pressing roller 320 is pressed toward the heating roller 310 by an elastic member 330. Accordingly, a portion of the elastic layer 322 is deformed to form a fusing nip 340. The pressing roller 320 is not limited to the form illustrated in FIG. 2. For example, the pressing roller 320 may have the same form as that of the heating roller 310 illustrated in FIG. 3. Also, the heat source 350 may be formed both in the heating roller 310 and the pressing roller 320.

Figure 4:
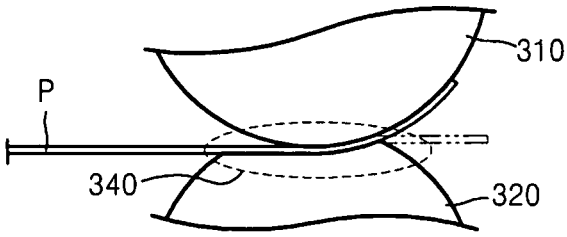
FIG. 4 illustrates a printing medium being wound around an external circumference of a heating roller.

Referring to FIG. 4, the printing medium P passed through the fusing nip 340 is separated mostly due to rigidity of the printing medium P itself as illustrated by a dotted line. However, in some circumstances, the fused toner on the surface of the printing medium P is attached to the heating roller 310 and thus the printing medium P is not separated from the heating roller 310 but wound around the outer circumference of the heating roller 310, thereby causing a jam.

Figure 5:
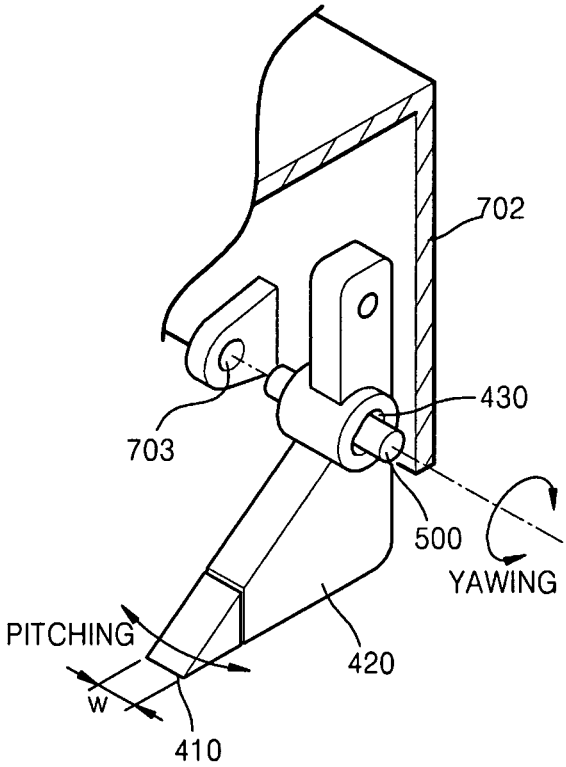
FIG. 5 is a perspective view illustrating a separation member according to an embodiment of the present disclosure.

In order to prevent the above problem, a separation member 400 to separate the printing medium P passed through the fusing nip 340 from the heating roller 310 may be formed as illustrated in FIG. 2. The separation member 400 is rotatably mounted on a rotation axis 500 that is parallel to the heating roller 310 and has a fixed position. Referring to FIGS. 2 and 5, the separation member 400 includes a hollow portion 430 into which the rotation axis 500 is inserted and a separation portion 410 that contacts the outer circumference of the heating roller 310. The separation portion 410 may be formed as a single unit with a body 420 that includes the hollow portion 430. Also, the separation portion 410 may be separately formed from the body 420 and be coupled to the body 420. In any of the cases, at least the separation portion 410 may be formed of a heat-resistant material, such as polyphenylene sulfide (PPS), a polyimide (PI) resin, or the like. An elastic member 600 applies an elastic force to the separation member 400 in a direction in which the separation portion 410 contacts the outer circumference of the heating roller 310.

A plurality of separation members 400 may be mounted in a lengthwise direction of the heating roller 310. For example, as illustrated in FIGS. 2 and 5, a holder 702 having an insertion hole 703 into which the rotation axis 500 is inserted may be coupled to a housing 701 of the fusing apparatus 90. The rotation axis 500 may be inserted into the insertion hole 702 with pressure through the hollow portion 430 of the separation member 400. Thus, the separation member 400 may be rotatably mounted on the rotation axis 500.

Figure 6:
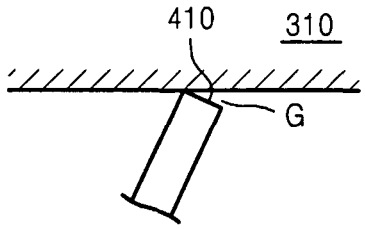
FIG. 6 illustrates a separation member being in partial contact with an outer circumference of a heating roller, according to an embodiment of the present disclosure.

Since the separation member 410 is in contact with the outer circumference of the heating roller 310 due to the elastic force of the elastic member 600, the separation member 410 may damage the releasing layer 312 of the heating roller 310 due to a long time of use. As illustrated in FIG. 5, the separation portion 410 has a predetermined width W along the lengthwise direction of the heating roller 310; the whole width W may preferably contact the outer circumference of the heating roller 310. Otherwise, if only a portion of the separation portion 410 contacts the outer circumference of the heating roller 310 (refer to FIG. 6), the elastic force of the elastic member 600 may be concentrated only on the contacted portion, which may further increase the possibility that the releasing layer 312 is damaged. In circumstances such as when the rotation axis 500 and the lengthwise directions of the heating roller 310 are not parallel and thus run-out characteristics of the outer circumference of the heating roller 310 are degraded, or the outer circumference of the heating roller 310 is totally or partially formed in a crown or inverted crown shape in a processing operation, or the heating roller 310 is deformed due to a long time of use and thus the cylindricity of the outer circumference of the heating roller 310, is decreased, only a portion of the separation portion 410 may contact the outer circumference of the heating roller 310. Also, if only a portion of the separation portion 410 contacts the outer circumference of the heating roller 310, the printing medium P may be jammed in a gap G between the separation portion 410 and the outer circumference of the heating roller 310.

Figure 7:
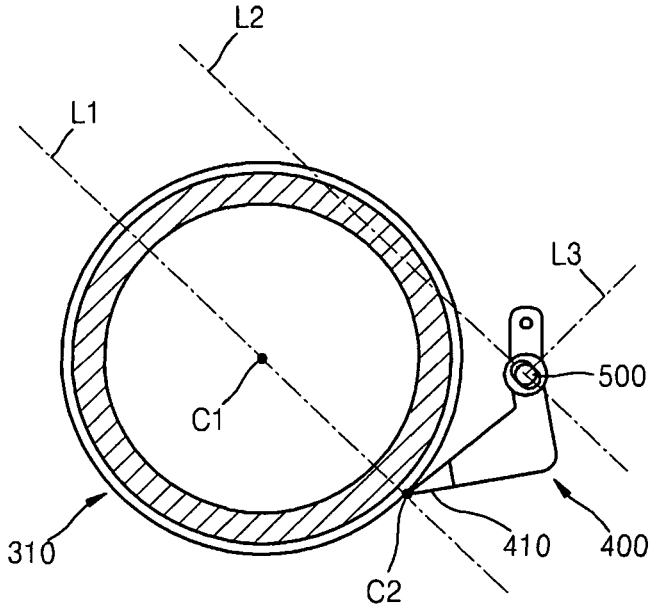
FIG. 7 is a schematic view illustrating a pitching axis of a separation member according to an embodiment of the present disclosure.
Figure 8:
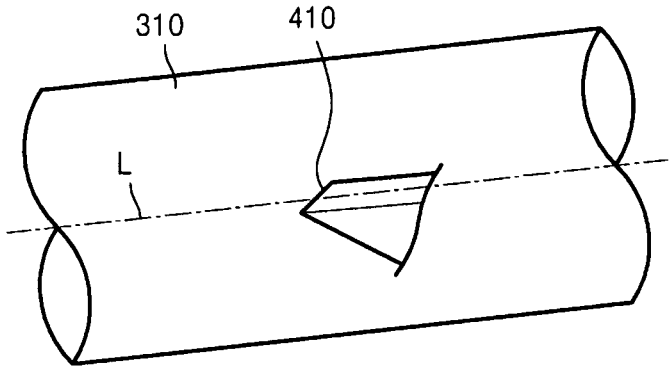
FIG. 8 is a schematic view illustrating a separation member and a heating roller in contact with each other when an inclination of a pitching axis is excessive, according to an embodiment of the present disclosure.

According to the current embodiment of the present disclosure, the position of the rotation axis 500 is fixed, and the separation member 400 is installed so as to rotate, that is, to yaw, around the rotation axis 500. At the same time, the separation member 400 is installed so as to be able to be pitched in order to prevent the separation portion 410 and the outer circumference of the heating roller 310 from partially contacting each other. Referring to FIG. 7, a line L1 connecting a center C1 of the heating roller 310 and a contact point C2 between the separation portion 410 and the outer circumference of the heating roller 310, a line L2 that is parallel to the line L1 and passes through a center of the rotation axis 500, and a line L3 that is perpendicular to the line L2 and passes through the center of the rotation axis 500 are assumed, and an inclination angle of a pitching axis of the separation member 400 with respect to the line L3 may be within a range of ±10°, and preferably, the pitching axis of the separation member 400 may be the line L3. If the pitching axis of the separation member 400 is excessively inclined with respect to the line L3, as illustrated in FIG. 8, since the separation portion 410 is inclined with respect to the lengthwise direction of the heating roller 310, a portion of the width W of the separation portion 410 does not contact the outer circumference of the heating roller 310. Accordingly, the separation performance of the separation member 400 may decrease, and the possibility of a jam may increase. In addition, the elastic force applied to the separation member 400 by the elastic member 600 may be concentrated on a portion of the width W of the separation portion 410, which increases the chances of that the releasing layer 312 is damaged.

Figure 9:
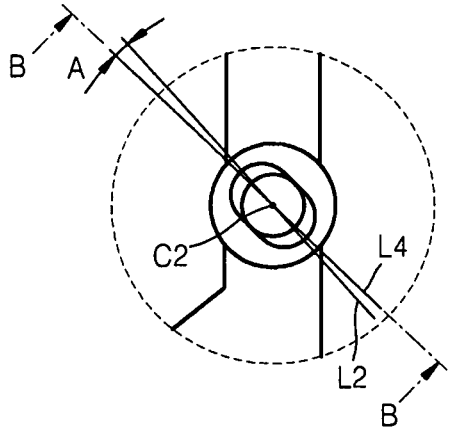
FIG. 9 is a detailed diagram of a hollow portion of a separation member according to an embodiment of the present disclosure.
Figure 10:
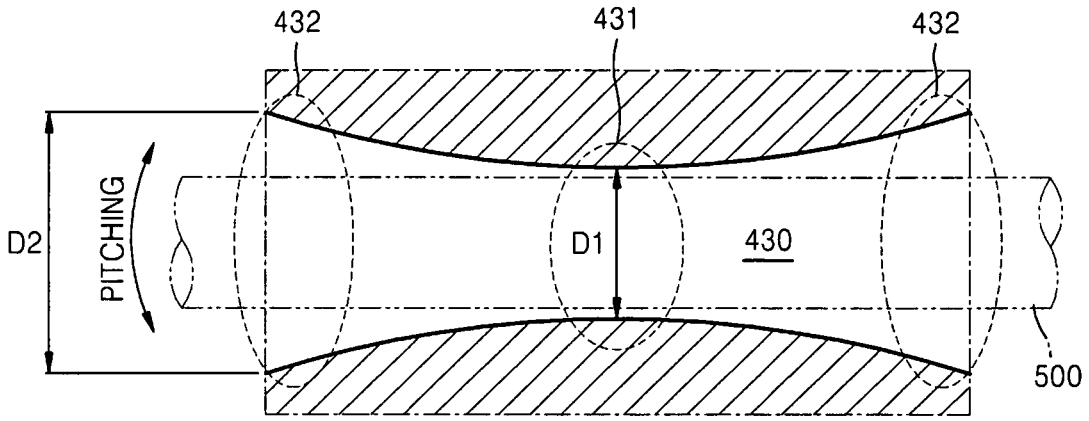
FIG. 10 is a cross-sectional view of the hollow portion of FIG. 9 cut along a line B-B'.

FIG. 9 is a detailed side cross-sectional view of the hollow portion 430, and FIG. 10 is a cross-sectional view of the hollow portion 430 of FIG. 9 cut along a line B-B'. A form of the hollow portion 430 that satisfies the above-described conditions will be described with reference to FIGS. 9 and 10. A diameter of a center portion 431 of the hollow portion 430 is such that the rotation axis 500 may pass through it and that the separation member 400 may be rotated, that is, yawed, by the rotation axis 500. Here, if a cross-section of the center portion 431 is a circle, a diameter D1 refers to a diameter of the circular cross-section, and if a cross-section of the center portion 431 is a long hole, the diameter D1 refers to a length of a short axis of the long hole. Two end portions 432 are long hole-shaped, and a length of a short axis of the two end portions 432 is the same as the diameter D1 of the center portion 431, and a length D2 of a long axis of the two end portions 432 is longer than the diameter D1 of the center portion 431. That is, a cross-section of the hollow portion 430 has a long hole shape whose length of a long axis increases in an axis direction of the rotation axis 500. Here, a long axis direction L4 may preferably be parallel to the line L1 that connects the center C1 of the heating roller 310 and the contact point C2 between the separation portion 410 and the outer circumference of the heating roller 310. According to this configuration, the pitching axis of the separation member 400 corresponds to the line L3. An inclination angle in the long axis direction L4 with respect to the line L1, that is, an inclination angle A in the long axis direction L4 with respect to the line L2, which is parallel to the line L1 and passes through the long hole, that is, the center of the rotation axis 500, may be within a range of ±10°. According to this configuration, an inclination angle with respect to the line L3 of the pitching axis is within a range of ±10°.

Figure 11:
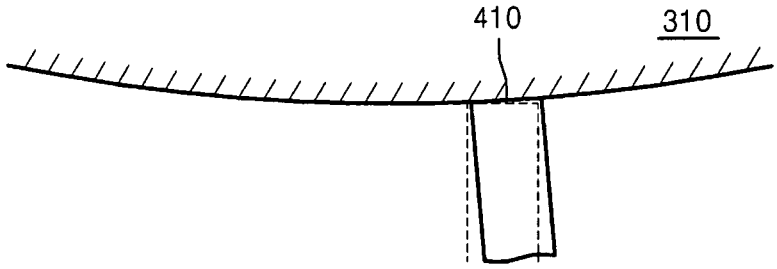
FIG. 11 is a schematic view illustrating a separation member with its whole width in contact with a heating roller having a crown-shaped outer circumference by pitching a separation member.

According to the above-described configuration, the separation member 400 can be yawed and pitched with respect to the rotation axis 500. Accordingly, even in circumstances such as when the lengthwise directions of the rotation axis 500 and the heating roller 310 are not parallel to each other and thus the run-out characteristics of the outer circumference of the heating roller 310 are degraded, or the outer circumference of the heating roller 310 is totally or partially formed in a crown or inverted crown shape in a processing operation, or the heating roller 310 is deformed due to a long time of use and thus the cylindricity of the outer circumference of the heating roller 310 is decreased, or the like, the separation member 400 is pitched in accordance with the form of the outer circumference of the heating roller 310 and thus the whole width W of the separation portion 410 may contact the outer circumference of the heating roller 310. For example, in FIG. 11, if the outer circumference of the heating roller 310 has a crown shape, the separation portion 410 partially contacts the heating roller 310 as illustrated by a dotted line, but as the separation member 400 is pitched as illustrated by a solid line, the whole width W of the separation portion 410 may contact the outer circumference of the heating roller 310.

Also, by limiting a pitching direction of the separation member 400 such that a direction of the width W of the separation portion 410 is aligned in the lengthwise direction of the heating roller 310, the whole width W of the separation portion 410 may easily contact the outer circumference of the heating roller 310. Also, since the rotation axis 500 is fixed, and a pitching operation of the separation member 400 is realized as a seesaw motion with respect to the rotation axis 500, pitching resistance of the separation member 400 is reduced and the separation member 400 may be easily pitched accordingly.

As described above, according to the fusing apparatus of the embodiments of the present disclosure, the danger of damage or a jam of the releasing layer 312 due to a partial contact between the separation portion 410 and the heating roller 310 may be reduced. Also, along with the trend of high speed of image forming apparatuses, a fusing apparatus that can meet the demand for a long lifetime may be provided.

Figure 12:
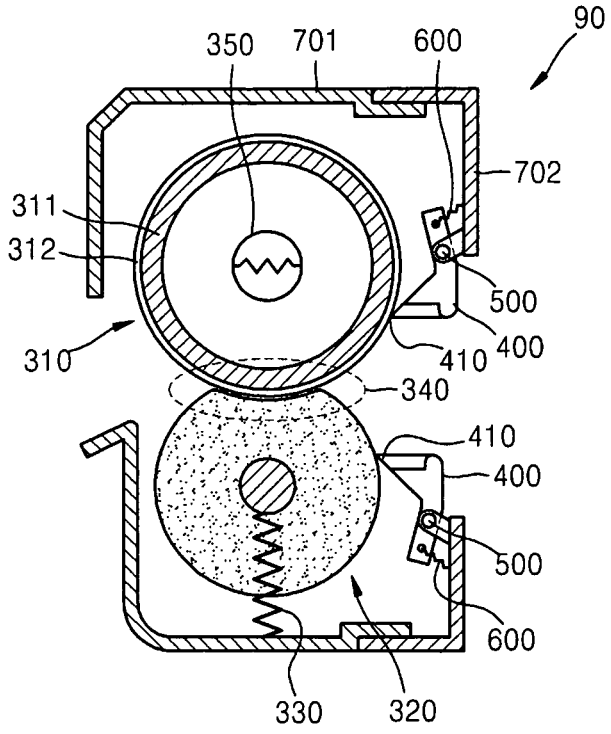
FIG. 12 is a structural diagram illustrating a fusing apparatus according to another embodiment of the present disclosure.

While in the above embodiments, separation of the printing medium P from the outer circumference of the heating roller 310 is described, the scope of the embodiments of the present disclosure is not limited thereto. As illustrated in FIG. 12, the separation member 400 may also be applied to separate the printing medium P from an outer circumference of the pressing roller 320.

Also, the fusing apparatus applied to a monochromatic image forming apparatus has been described in the above embodiments of the present disclosure. However, the fusing apparatus according to the above embodiments of the present disclosure may also be applied to a multi-path electrophotographic color image forming apparatus in which toner images corresponding to cyan, magenta, yellow, and black colors are sequentially formed and transferred first to an intermediate transfer medium, and then transferred finally to a printing medium, or a single-path electrophotographic color image forming apparatus in which toner images corresponding to cyan, magenta, yellow, and black colors are formed on a plurality of photoreceptors, and are transferred to an intermediate transfer medium and then finally to a printing medium or directly to a printing medium.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A fusing apparatus to fuse a toner image transferred to a printing medium by applying heat and pressure, comprising:

a heating roller and a pressing roller that form a fusing nip and rotate by being engaged with each other;

a separation member that separates a printing medium passed through the fusing nip, from one of the heating roller and the pressing roller, the separation member including a separation portion that contacts an outer circumference of the roller from which the printing medium is to be separated, and is capable of rotating around a rotation axis that is parallel to a lengthwise direction of the roller from which the printing medium is to be separated; and an elastic member that applies an elastic force to the separation member that rotates the separation portion to contact the outer circumference of the roller from which the printing medium is to be separated, wherein the separation member comprises a hollow portion into which the rotation axis is inserted, wherein the hollow portion comprises a center portion rotatably supporting the rotation axis and two end portions having a long hole shape, and wherein a long axis direction of the two end portions has an inclination angle within a range of ±10° with respect to a line that connects a contact point between the separation portion and the outer circumference of the roller from which the printing medium is to be separated and the center of the roller from which the printing medium is to be separated, so that the separation member is pitched in the direction of the long axis.

2. The fusing apparatus of claim 1, wherein the hollow portion has a cross-section having a long hole shape whose long axis length gradually increases from the center portion toward the two end portions of the hollow portion.

3. The fusing apparatus of claim 1, wherein the center portion has a circular cross-section.

4. The fusing apparatus of claim 1, wherein the long axis of the long hole is parallel to the line that connects the contact point between the separation portion and the outer circumference of the roller from which the printing medium is to be separated and the center of the roller from which the printing medium is to be separated.

5. The fusing apparatus of claim 1, wherein the roller from which the printing medium is to be separated is the heating roller.

6. The fusing apparatus of claim 1, wherein the separation member comprises a plurality of separation members mounted in a lengthwise direction of the heating roller.

7. The fusing apparatus of claim 1, further comprising:

a housing;

a holder coupled to the housing, the holder having an insertion hole into which the rotation axis is inserted coupled to the housing, wherein the rotation axis is inserted into the insertion hole with pressure through the hollow portion of the separation member.

8. The fusing apparatus of claim 1, wherein the separation portion has a predetermined width along the lengthwise direction of the heating roller.

9. An electrophotographic image forming apparatus comprising:

a photoreceptor on which an electrostatic latent image is formed;

a developer that supplies a toner to the electrostatic latent image to form a visible toner image; and the fusing apparatus of claim 1 that fuses the toner image transferred to a printing medium by applying heat and pressure.

10. The electrophotographic image forming apparatus of claim 9, wherein the hollow portion has cross-section having a long hole shape whose long axis length gradually increases from the center portion toward the two end portions of the hollow portion.

11. The electrophotographic image forming apparatus of claim 9, wherein the center portion of the fusing apparatus has a circular cross-section.

12. The electrophotographic image forming apparatus of claim 9, wherein the long axis of the long hole is parallel to the line that connects the contact point between the separation portion and the outer circumference of the roller from which the printing medium is to be separated and the center of the roller from which the printing medium is to be separated.

13. The electrophotographic image forming apparatus of claim 9, wherein the roller from which the printing medium is to be separated is the heating roller.

* * * * *